United States Patent [19]

Persson

[11] 4,365,782

[45] Dec. 28, 1982

[54] MOULDING TOOL

[75] Inventor: Bengt Persson, Götene, Sweden

[73] Assignee: Br. Perssons Cementvarufabrik AB, Sweden

[21] Appl. No.: 313,030

[22] Filed: Oct. 19, 1981

Related U.S. Application Data

[63] Continuation of Ser. No. 124,671, Feb. 26, 1980, abandoned.

[30] Foreign Application Priority Data

Mar. 1, 1979 [SE] Sweden ..... 7901847

[51] Int. Cl.[3] ..... B28B 7/06; B28B 7/16; B28B 23/00

[52] U.S. Cl. ..... 249/91; 425/44; 425/124; 425/116; 249/8

[58] Field of Search ..... 249/83, 91, 93, 94, 249/2, 8, 117; 425/DIG. 44, DIG. 124, 110, 116, 117, 123, 125

[56] References Cited

U.S. PATENT DOCUMENTS

| | | | |
|---|---|---|---|
| 2,305,252 | 12/1942 | Hayden . | |
| 3,036,349 | 5/1962 | Edgerton | 425/DIG. 44 |
| 3,108,329 | 10/1963 | Chapman | 249/91 |
| 3,685,782 | 8/1972 | Kowell | 249/94 X |
| 3,712,575 | 1/1973 | Bement et al. | 249/91 |
| 3,810,339 | 5/1974 | Russo . | |
| 3,933,334 | 1/1976 | Edwards | 249/91 X |
| 4,084,780 | 4/1978 | Mess | 249/91 X |
| 4,159,099 | 6/1979 | Maguire | 249/93 |

FOREIGN PATENT DOCUMENTS

| | | |
|---|---|---|
| 404996 | 11/1978 | Sweden . |
| 407701 | 4/1979 | Sweden . |

*Primary Examiner*—J. Howard Flint, Jr.
*Attorney, Agent, or Firm*—Beveridge, DeGrandi & Kline

[57] ABSTRACT

Moulding tool for making an article from vibrated concrete optimized as regards strength, the article having embedded therein a tubular sleeve located by a pin during the moulding process. The moulding tool is designed to keep the interior of the sleeve free from concrete and to decrease wear and mechanical stress exerted on the pin during the moulding process. Such a moulding tool is characterized in that, during the moulding process, the pin extends through a sealing and dampening body made from an elastic or semi-hard material, the sealing and dampening body having sealing engagement with the pin. The sealing and dampening body is compressed by the sleeve so that a sealing engagement is achieved between one end of the sleeve and the sealing and dampening body and between the other end of the sleeve and a surface of the moulding tool.

2 Claims, 5 Drawing Figures

MOULDING TOOL

This is a continuation of application Ser. No. 124,671, filed Feb. 26, 1980, now abandoned.

The present invention relates to a moulding tool particularly designed for moulding articles from vibrated concrete, the articles having embedded therein an object such as a tubular sleeve or the like.

When making different kinds of articles from concrete such as pavement slabs, different types of curb stones or the like, it has been common practice to use a rather dry concrete composition. By pressing the concrete in a mould, the intended shape of the article has been achieved. Then the article has been removed from the mould and hardened. This method of manufacture does not give rise to any particular problems regarding design of the mould or keeping close tolerances either regarding shape or dimensions. However, the quality of the concrete article is lower partially because the concrete composition does not have optimum proportions of water, cement and aggregates, and partially because the concrete can not be made without excessive pores inspite of being pressed at a high pressure. Further, this technique of manufacture involves certain limitations regarding the shape of the article, as it can not, without problems, have different dimensions at different locations in the pressing direction. Finally it is almost impossible to have other objects embedded in an article manufactured in this way, as such an object could easily be displaced to an incorrect position during pressing, be destroyed by the pressure, or, if it is hollow, be filled with concrete.

When making certain types of concrete curb stones the manufacturing method indicated above can not be used for several reasons. When making curb stones for streets and roads a much better quality of concrete is required than can be achieved according to the method indicated above. To achieve this high quality there is needed a quite different composition of the concrete, i.e. the concrete must contain more water than is the case in the above concrete. Further it is necessary to vibrate the concrete when poured into the mould to increase the density and to avoid formation of pores and bubbles. Finally, in certain types of curb stones it is necessary to have certain objects embedded in the concrete, and the positions of these objects are usually critical.

Even if the use of a concrete having a composition optimized as regards strength is advantagous in many respects, certain problems arise due to the fact that there is easily separated a rather flowable concrete slime having a tendency of entering any cavity and filling it. This causes problems for all movable parts of moulds for making such concrete articles, as the movability of such parts easily is lost if the concrete slime is allowed to enter the space between them and harden there. Further, it is difficult to have an object embedded in concrete of this quality because the concrete slime has a tendency of entering the object if it is hollow, and because the object easily is moved from the correct position when vibrating the concrete. To make it possible at all to have an object embedded in this way, it is necessary to locate the object very efficiently. It is also necessary to seal the object in such a way that no concrete slime can enter into the cavities thereof in spite of the fact that the consistency of the slime becomes waterlike under influence of the vibrations. Finally, the vibrating of the concrete gives rise to very severe conditions for the mould, particularly the movable parts thereof, since during the vibrating such parts are subject to rapid movements causing hard wearing and possibly also breakage of the parts.

Therefore, the present invention has as a purpose to provide a moulding tool eliminating the above problems encountered when embedding an object in a concrete article having proportions of the concrete optimized as regards strength and being vibrated during the moulding process.

According to the invention this purpose is achieved if a moulding tool comprising a pin for locating the object to be embedded in the concrete is characterized in that the pin, during the moulding process, extends through a sealing and dampening body made from an elastic or semi-hard material, the sealing and dampening body having a sealing abutment both to the pin and to the object.

In an important embodiment of the invention the moulding tool is designed especially for making concrete curb stones having embedded therein plastic sleeves for receiving, for example, a fastening nail. This embodiment is preferably characterized in that an end portion of the pin extending outside the mould cavity is connected to an operating mechanism for withdrawing the pin from the sleeve at least to a position within the sealing and dampening body.

In one embodiment of the invention for making concrete curb stones of the type indicated, it is preferably arranged that the sealing and dampening body has a length extending into the mould cavity such a distance as to be compressed somewhat by the sleeve in the longitudinal direction of the pin when closing the moulding tool, whereby the opposite end of the sleeve is urged into sealing abutment against an opposing surface of the moulding tool.

In another embodiment of the invention for making concrete curb stones of the type indicated above, it is preferably arranged that the sealing and dampening body has a surface facing the mould cavity, said surface being level with the surrounding surface of the moulding tool, that the surface opposing the sealing and dampening body is provided with a mould insert, the distance between adjacent surfaces of the sealing and dampening body and the mould insert being slightly less than the length of the sleeve so that the sleeve is pressed into sealing abutment against both the sealing and dampening body and the mould insert.

The invention is now to be described more in detail below, reference being made to the accompanying drawings. On these, FIG. 1 shows a cross sectional view of a concrete curb stone having embedded therein plastic sleeves for receiving fastening nails.

Figure 1:
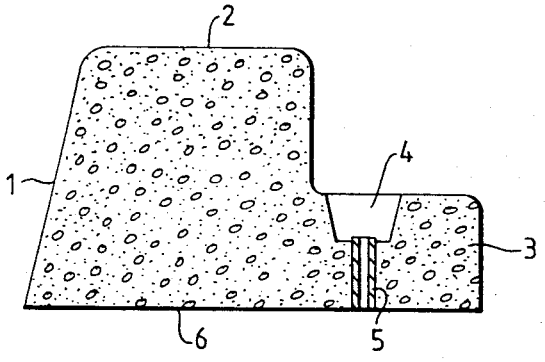

In FIG. 1 there is shown a cross sectional view of an article in the form of a concrete curb stone made from a concrete composition optimized as regards strength and being vibrated during manufacture. It is clearly seen that the curb stone has a somewhat sloping surface 1 facing the driveway. The curb stone also has an upper surface 2 and on its side remote from the sloping surface a projection 3 on the upper surface of which are provided a series of holes 4. From the bottom of each hole there extends a short distance the upper end portion of a plastic sleeve 5 which is embedded in the concrete and which extends to the lower side 6 of the curb stone. The sleeve 5 is made from semi-hard plastic and is provided for receiving with a tight fit such hardened steel nails as are used for fastening the curb stone, for example on an asphalt surfacing. FIG. 1 also clearly shows that the upper end of the sleeve protrudes slightly above the bottom of the hole 4 which is advantageous for avoiding breaking of the concrete by the head of the nail when the nail is driven through the sleeve. As the sleeve and the nail have a very close fit, it is evident that the interior of the sleeve must be quite free from concrete after the moulding is finished.

Figure 2:
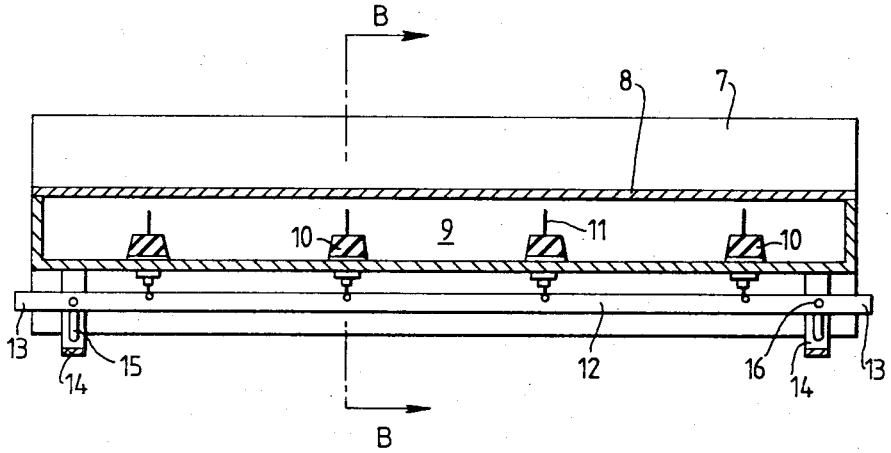
FIG. 2 shows a longitudinal sectional view, substantially on line A—A in FIG. 3, of a moulding tool for making the curb stone of FIG. 1.
Figure 3:
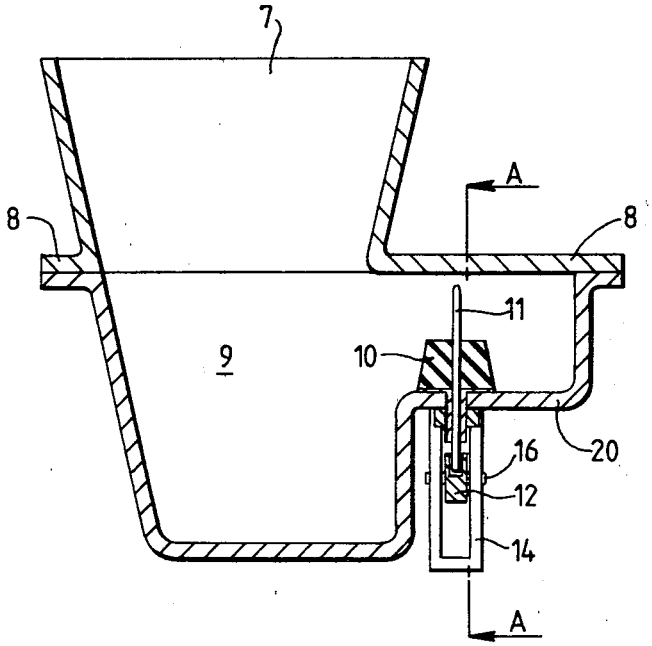
FIG. 3 shows a schematic cross sectional view, substantially on line B—B in FIG. 2.

In FIG. 3 there is shown as a cross sectional view an example of a moulding tool for making the concrete curb stone of FIG. 1. It is seen that the upper portion of the moulding tool comprises a filling chute or hopper 7 for filling concrete through the lid or cover member 8 into the mould cavity 9. The mould cavity has to the right (as seen in FIG. 3) a projecting portion corresponding to the projection 3 of the curb stone of FIG. 1. Thus, the curb stone is made inverted when being moulded in the tool according to FIG. 3 so that the bottom surface 6 will be located at the lower side of the lid 8. To produce the holes 4 when moulding the curb stone the moulding tool is provided with a proper number of rubber pads 10 having a shape corresponding to the shape of the holes 4. For locating the plastic sleeves 5 during the moulding there are provided pins 11 extending through the rubber pads 10. The pins 11 are displaceable in their longitudinal directions through the rubber pads 10 to lower positions where their upper ends are located within the rubber pads. During this withdrawal of the pin, which is carried out just before opening the mould and removing the finished curb stone, the plastic sleeve 5 is held in place in its position embedded in the concrete by engaging the rubber pad 10. To this end, as depicted in FIG. 2, the lower ends of the pins could be pivotably connected to a bar 12 arranged in the longitudinal direction of the mould and having end portions 13 for engaging abutments when the mould is inverted just before removing the finished curb stone, thereby causing the pins to be retracted back into the rubber pads 10. Preferably the bar is guided in two or more yokes 14 which have slots 15 and which receive the bar. The bar has permanently fastened thereto pegs 16 received in the slots 15 to locate the bar in its longitudinal direction.

Figure 4:
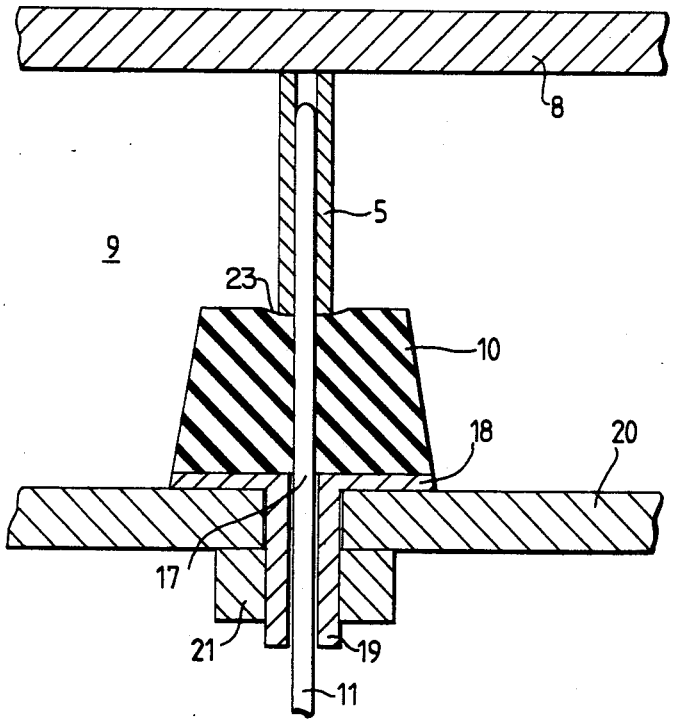
FIG. 4 shows on a bigger scale the moulding tool of FIG. 3, certain parts being deleted for the sake of clarity.

FIG. 4 shows on a bigger scale the arrangement of one pin 11 and one rubber pad 10, the operating device of the pin being deleted for the sake of clarity. The pin 11 is shown displaced to its moulding position in the mould cavity 9, and it is received in the plastic sleeve 5 to be embedded in the concrete curb stone. It is seen that the rubber pad 10 has such a length extending into the mould cavity 9 that it is slightly compressed in an area 23 by the sleeve 5 in the longitudinal direction of the pin 11, whereby a depression is created around the sleeve at the center of the rubber pad. This depression around the pin causes the sleeve 5 to extend above the bottom surface of the hole 4 in the finished concrete curb stone (FIG. 1). The depression in the rubber pad 10 also provides for a rather big axial force being exerted on the plastic sleeve 5, whereby proper sealing between the ends of the sleeve and the lid 8 and the rubber pad 10 is assured.

As mentioned above, the curb stone of FIG. 1 is made from vibrated concrete, which means that the semi-liquid concrete compound received in the mould cavity has to be exposed to forceful vibrations in the moulding tool. This also causes a very big stress on the rather thin pin 11 as it, in spite of being received in the sleeve 5, has a tendency to move together with those wave motions present in the concrete. In order to dampen, as far as possible, these oscillations generated in the pin 11, the pin is arranged with a tight fit in the rubber pad 10, whereby the rubber pad by internal friction dissipates the oscillating energy from the pin 11, giving it a very small amplitude of oscillation and decreasing the mechanical stress particularly at its lower portion 17 extending through the lower wall of the moulding tool.

The tight fit between the pin 11 and the rubber pad 10 also prevents the slime of concrete from penetrating into the channel receiving the pin in the rubber pad. Thus, the pin will be free from slime all the time, whereby the interior of the sleeve 5 also is prevented from being contaminated by such slime possibly sticking to the pin 11. A double security is created to assure that no slime of concrete enters the sleeve, partly by wiping off the pin 11 and partly by forcefully pressing both ends of the sleeve 5 against the adjacent portions of the moulding tool.

As seen from FIG. 4 the pad 10 is fastened to a washer 18, for example by vulcanizing. The washer has at a central portion a shank 19 extending through the lower wall or body member 20 of the moulding tool. The washer and the shank are preferably fastened by a nut 21.

Figure 5:
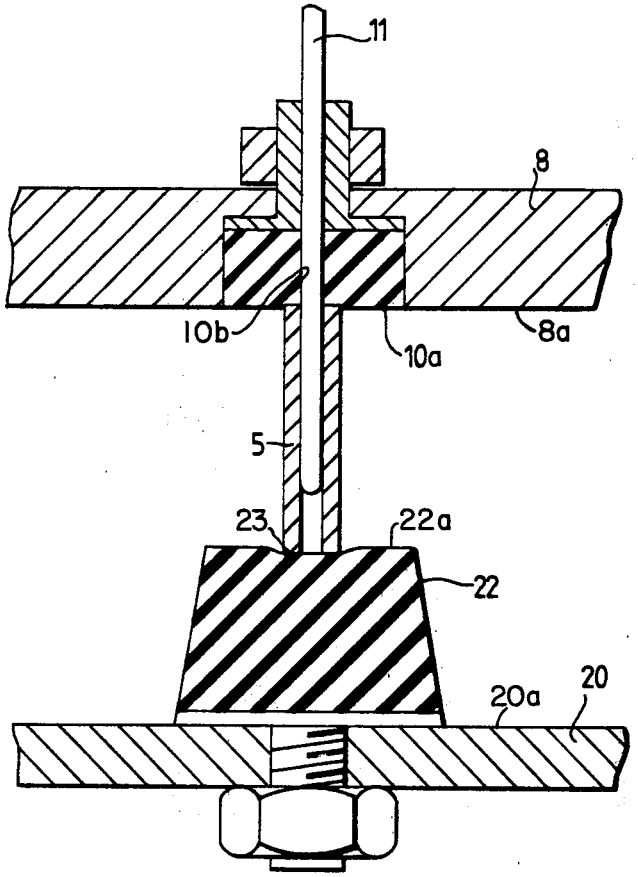
FIG. 5 shows a modified embodiment in a view corresponding to FIG. 4.

In FIG. 5 is shown a modified embodiment of the moulding tool of FIGS. 2 and 3. In this embodiment the pins 11 do not extend through the lower wall 20 but are arranged to extend through the lid 8. In this embodiment the lid 8 has a somewhat greater thickness than is the case according to FIGS. 2–4, at least in the areas around the pins. The rubber pad or resilient sealing and dampening member **10*a* which engages the pin is in this embodiment received in a recess in the lid 8 and has its lower surface 10*a* level with the lower internal surface 8*a* of the lid. The fit between the open passage 10*b* of the rubber pad 10*a* and the pin 11** corresponds to what has been described above.

To provide a hole in the concrete curb stone also in the embodiment of FIG. 5 there is provided a resilient member in the form of a mould core or insert 22 having a surface **22*a* located on the internal surface 20*a* of lower wall 20 at an opposing position in alignment with the rubber pad 10*a*, the mould core 22 having substantially the same shape as the rubber pad 10 of FIG. 4. Preferably both the rubber pad 10*a* and the mould core 22 are fastened to the moulding tool in the same manner as the rubber pad 10 of FIG. 4. To have the object or plastic sleeve 5 extend above the bottom of the hole 4 (FIG. 1), the mould core 22 is somewhat softer or more resilient than is the rubber pad 10*a* on the lid 8. By this means is also achieved the axial urging of the sleeve 5 against the rubber pad 10*a* and the mould core 22 whereby the sleeve is sealed. Also in this embodiment the dampening action exerted by the rubber pad 10is of great importance to the operating life of the pin 11**.

In the embodiment of FIG. 5 each pin 11 is preferably provided with its own operating mechanism, for example a pneumatic or hydraulic cylinder, having such a stroke that the pin in retracted position has its end located in the rubber pad 10*a* just above the lower surface thereof.

The invention could be modified within the scope of the following claims. Thus, the described shape of the concrete curb stone is only an example and it is evident that the invention could be applied to any process of moulding vibrated concrete if there is to be embedded in the concrete an object having at least one opening for receiving a pin. Further, the described operating mechanisms of the pins are not the only ones possible, but any operating mechanism capable of producing a linear movement of a suitable stroke might be used.

I claim:

1. A moulding tool for moulding an article from vibrated concrete, the article having embedded therein an object adapted to receive a pin to locate the object, said moulding tool comprising:

a body member and a cover member cooperating to define a mould cavity having internal surfaces and adapted for vibration to vibrate concrete therein;

a resilient sealing and dampening member in a first one of said body member and said cover member, having an open passage therethrough, and having an exposed surface facing said mould cavity and coplanar with a first internal surface of said mould cavity;

a pin member slidingly but sealingly passing through said sealing and dampening member open passage and normally extending from said sealing and dampening member open passage into said mould cavity and adapted to receive an object to be embedded in the moulded article to retain the object within the mould cavity adjacent said sealing and dampening member, said sealing and dampening member dampening vibration of said body member and said cover member to protect said pin member and the object from such vibrations, said pin member capable of being withdrawn from the object to a position within said sealing and dampening member open passage; and a resilient member extending into said mould cavity from the other one of said body member and said cover member and having a surface positioned opposite said sealing and dampening member to form a mould core for engaging the object while the object is retained by said pin member to depress said resilient member surface in the area immediately adjacent the object to retain the object in such position even after said pin member is withdrawn therefrom to the position within said sealing and dampening member open passage, with said sealing and dampening member dampening vibrations from said pin member and the object as the concrete is vibrated and cooperating with said resilient member to seal the interior of the object from the concrete;

said cover member being removable from said body member to permit removal from the mould cavity of the moulded article with the object embedded therein while said sealing and dampening member and said resilient member remain with their respective ones of said body member and said cover member.

2. A moulding tool as claimed in claim 1 further comprising:

operating means coupled to said pin member for withdrawing said pin member to the position within said sealing and dampening means opening.

* * * * *